US008038724B2

(12) United States Patent
Cho et al.

(10) Patent No.: US 8,038,724 B2
(45) Date of Patent: Oct. 18, 2011

(54) DECORATED HAIR PIECES AND METHOD FOR DECORATING HAIR PIECES

(75) Inventors: Do Hyong Cho, Suwon-si (KR); Sung Cheol Cho, Hwa-Sung (KR)

(73) Assignee: Keojin Industrial Co., Suwon-si, Kyungki-Do (KR)

( * ) Notice: Subject to any disclaimer, the term of this patent is extended or adjusted under 35 U.S.C. 154(b) by 155 days.

(21) Appl. No.: 12/457,652

(22) Filed: Jun. 17, 2009

(65) Prior Publication Data

US 2010/0000562 A1 Jan. 7, 2010

Related U.S. Application Data

(63) Continuation of application No. 11/543,197, filed on Oct. 5, 2006, now abandoned.

(30) Foreign Application Priority Data

Nov. 29, 2005 (KR) ..... 10-2005-0114800

(51) Int. Cl.
*C11D 3/00* (2006.01)

(52) U.S. Cl. ..... 8/115.51

(58) Field of Classification Search ..... 8/115.51; 132/201–208
See application file for complete search history.

(56) References Cited

U.S. PATENT DOCUMENTS

| | | | |
|---|---|---|---|
| 3,599,647 | A | 8/1971 | Fabbri |
| 5,664,590 | A | 9/1997 | Plateroti et al. |
| 5,799,669 | A | 9/1998 | Briggs |
| 5,848,599 | A | 12/1998 | Todd |
| 5,899,211 | A | 5/1999 | Brown |
| 6,305,386 | B1 | 10/2001 | Wochadlo |
| 2001/0037813 | A1 | 11/2001 | Ra |
| 2005/0115581 | A1 | 6/2005 | Choi |

*Primary Examiner* — Rachel Steitz
(74) *Attorney, Agent, or Firm* — McKenna Long & Aldridge LLP

(57) ABSTRACT

A textile, such as a hairpiece, includes a plurality of fiber single-ply threads. The plurality of fiber single-ply threads are grouped such that designs may be created on desired portions of the plurality of fiber single-ply threads, such as a decolorized portion. The textile includes a fixed part to hold the fiber single-ply threads. A variety of techniques may be used to create a design on the plurality of fiber single-ply threads with precision. For example, various dispersion dyes on transcription paper could be applied to a surface of the single-ply threads with a heat pressing process. The textile, exhibiting designs on a plurality of fiber single-ply threads, is also configured to be attached or adorned.

7 Claims, 6 Drawing Sheets

DECORATED HAIR PIECES AND METHOD FOR DECORATING HAIR PIECES

This application is a Continuation of application Ser. No. 11/543,197 filed Oct. 5, 2006, now abandoned pending, which claims the benefit of Korean Patent Application No. 10-2005-0114800, filed on Nov. 29, 2005, which is hereby incorporated by reference for all purposes as if fully set forth herein.

BACKGROUND

1. Field of the Disclosure

The disclosure relates to decorated textiles that include decorations or designs formed or created on a plurality of fibers or threads, which may include hair attachments, extensions, and pieces.

2. Background

Individuals often dye their natural hair fibers for a variety of reasons or occasions. However, it is often difficult to create precise designs on natural hair fibers, as the designs have a tendency to smudge or streak as the dye is being applied. Although heat may be applied to prevent dye dispersion, the individual may not want their natural hair strands, which are composed of substances such as proteins, to become damaged from the process.

Further, individuals may be reluctant to frequently change designs or decorations on their natural hair strands because such actions are relatively costly and high maintenance. Also, these individuals may be reluctant to develop any further damage to their natural hair strands.

Accordingly, there is a need for a hairpiece and a method of decorating a hairpiece to include, for example, designs formed on the plurality of fibers that would overcome one or more of the problems described above.

SUMMARY

The present disclosure relates to hair pieces and methods of decorating hair pieces that provide designs that do not smudge or streak, and may be distinctly and precisely formed over a plurality of fiber single-ply threads. The hairpiece may be attached, adorned, and/or worn on the hair or elsewhere, as desired.

By using a hairpiece, the actual hair or element to which the hairpiece is attached does not have to be dyed or enhanced, thereby preventing the actual hair or element from being damaged by the hair design creating process.

Furthermore, a hair design may be added, changed, and/or removed frequently without causing damage to the hair or element that it is attached. Also, adding, updating, changing, and/or removing a design does not require that the entire time-consuming process of design creation and/or removal be carried out. Rather, it involves at least one of attaching, detaching, connecting, and securing the hairpiece to another element or set of elements, such as an individual's natural hair fibers. By using a decorated hairpiece, as disclosed herein, the time consuming process of adding a design to an individual's own natural hair strands is avoided, as the hairpiece provides a quick and easy alternative.

To achieve these and other advantages, as embodied and broadly described, a textile includes a plurality of fiber single-ply threads. A plurality of fiber single-ply threads may be selected followed by an appropriate and effective design technique. Alternatively, a desired design technique(s) may be selected followed by the selection of a plurality of fiber single-ply threads comprising a material that is suitable for the desired design technique(s). For example, the fiber single-ply threads for a printing technique may include polyester single-ply, acrylic, single-ply or nylon threads having a thickness in a range 50 to 150 micrometers. In other words, the selection of materials and design techniques for the decorated textile, such as a hairpiece, often takes into account the desired result.

The fiber single-ply threads may be arranged such that at least one surface may accommodate a design technique or application. To achieve a particular look or effect, the arrangement of single-ply threads may include selected decolored portions, a plurality of decolored fiber single-ply threads, or any combination thereof.

The plurality of fiber single-ply threads includes a fixing section that holds the arrangement of fiber single-ply threads. The fixing section includes portions of the fiber single-ply threads that may be sewn and folded. The folded portions may include more elaborate and extensive needlework. Optionally, the fixing section may be coated with an adhesive.

A myriad of designs may be conveyed to at least one surface of the fiber single-ply threads. The design(s) may include various colors, patterns, and artistic creations.

For example, the fiber single-ply threads may include a printed design formed of dispersion dyes. A heat pressing technique using transcription paper may be utilized to create a print design on the plurality of fiber single-ply threads. Design techniques involving transcription paper do not require that each color be applied one at a time. Rather, a multitude of colors may be transferred to the medium at the same time.

Also, any type of design, whether elaborate or simple, may be transferred to a plurality of fiber single-ply threads by the same heat-pressing process with relative ease.

Additional features and advantages of the disclosure may be set forth in part in the description which follows, and in part may be apparent from the description, or may be learned by practice of the invention. Certain objectives and advantages of the invention may be realized and may be attained by the structures and processes described in the written description, in the claims, and in the appended drawings.

BRIEF DESCRIPTION OF THE DRAWINGS

The accompanying drawings provide a further understanding of the disclosure incorporated herein, constitute a part of this specification, and illustrate various embodiments of the invention.

In the drawings.

DETAILED DESCRIPTION

Reference will now be made in detail to various embodiments of the present invention, examples of which are illustrated in the accompanying drawings.

Figure 1:
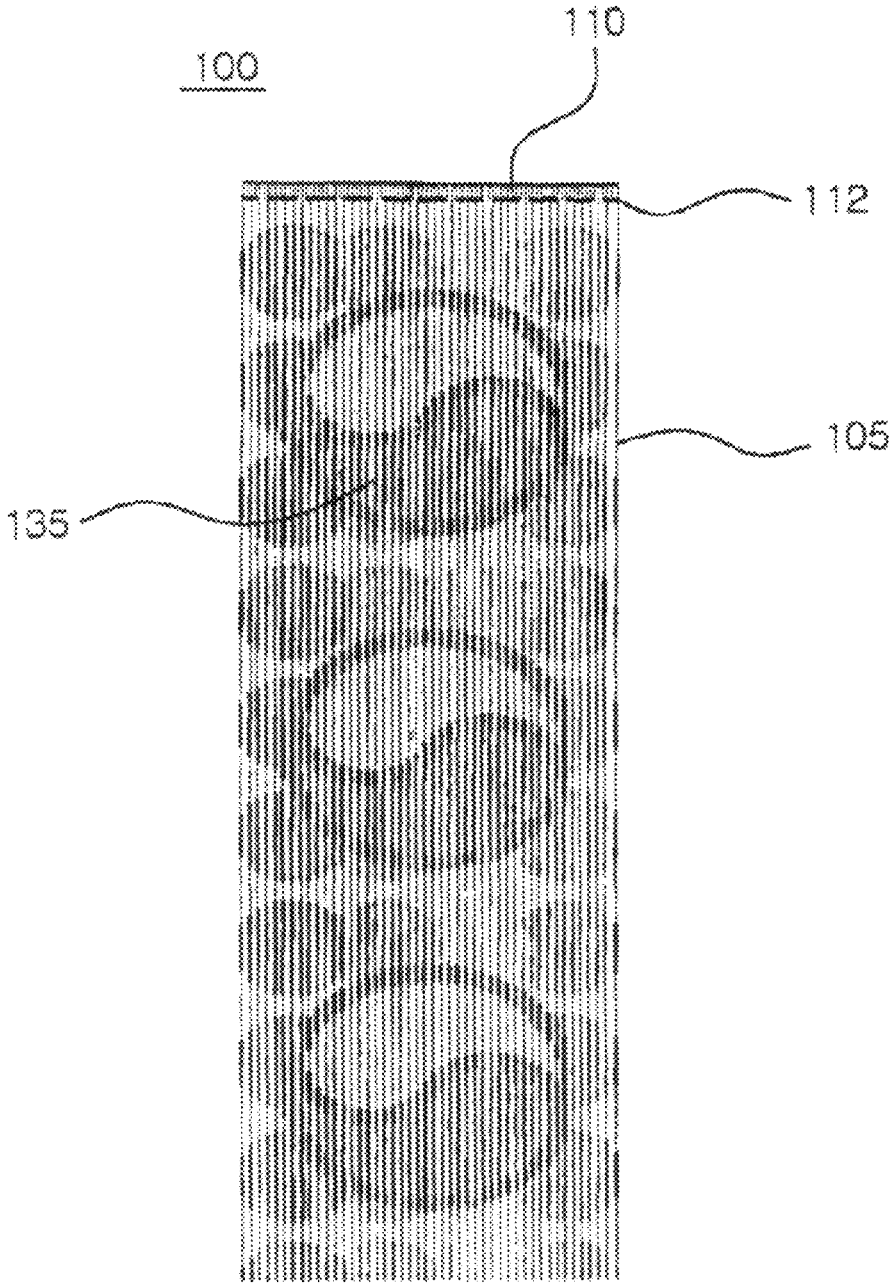
FIG. 1 is an exemplary and non-limiting illustration of a hairpiece in accordance with one embodiment of the present invention.

FIG. 1 is an exemplary and non-limiting illustration of a hairpiece including single-ply threads on which designs are printed.

As shown in FIG. 1, the hairpiece (100) includes a plurality of fiber single-ply threads (105). The fiber single-ply threads may vary in thickness. For example, the fiber single-ply threads may comprise a thickness similar to that of natural hair fibers, which may be in a range between 50 to 150 micrometers.

Various sizes and lengths may be selected for the hairpiece. For example, the hairpiece (100) may comprise a length between 10 cm and 20 cm. In fact, the hairpiece (100) may be any size. For instance, the hairpiece (100) may be sized in accordance with desired designs (135) and/or the intended use of the hairpiece. In other words, the hairpiece may include any desired length, width, and/or shape.

The fiber single-ply threads (105) may include polyester single-ply, acrylic single-ply, nylon, or any other suitable material. Fiber single-ply threads (105) using or including polyester single-ply may be desirable because they are more tolerant to heat, thereby being more resistant to damage.

The front surface of the hairpiece (100) as shown in FIG. 1, includes a TaeGuk design, which is a circle divided into two parts, and polka dots. Designs, such as various images and patterns may be included on more than one side of the hairpiece. Specifically, the designs may be included in any desired location to achieve a desired look, image, or effect. The hairpiece may include designs of a single color or a plurality of colors. Further, these colors may be mixed, enhanced, or amplified by any suitable means.

For example, the coloring of fiber single-ply threads (105) may be enhanced by performing a decoloring or bleaching process (403) prior to coloring, designing, or printing on a portion of the hairpiece. After performing a decoloring or bleaching process, the single-ply threads will lack their original color. In most instances, the decolored or bleached portions of the single-ply threads will appear white.

Designs on the hairpiece may be enhanced by including more than one design as shown in FIG. 1, which illustrates the hairpiece that includes both a background design, such as the polka dots and a foreground design, such as the TaeGuk. By creatively implementing various techniques and options, the hairpiece may achieve a desired look or effect, which may include elaborate designs or creations.

The fiber single-ply threads (105) are configured to be grouped or attached such that they collectively act like a canvas, thereby allowing elaborate designs to be created even though the threads may have substantial portions that are not attached or connected to each other.

The fiber single-ply threads of the printed hairpiece (100) may be held together in a number of different ways. For example, the printed hairpiece may include a fixing section (110). The fixing section (110) may be included or formed on a portion of the fiber single-ply threads, such as an area substantially near an end or at the end. The fixing section (110) of the hairpiece (100) allows the fiber single-ply threads (105) to be fixed firmly in place. The fixing section (110) may facilitate the process of printing designs on a hairpiece by keeping each fiber in its proper place.

The fixing section (110) may include sewn portions on the plurality of fiber single-ply threads (105). The sewn portion may be formed, for example, by a sewing machine. The sewn portion may be formed or created transverse or substantially perpendicular to a vertical length of the fiber single-ply threads (105). A sewn portion could also be positioned halfway along the length of the fiber single-ply threads (105). In fact, the sewn portion may be formed at any part of the fiber single-ply threads (105) in order to achieve a desired result.

The single-ply threads may be folded at the sewed line. The sewing machine may perform the sewing at the folded section. The sewing is performed such that the fixing section (110) is firm and the fiber single-ply threads (105) are aligned and uniform. To reinforce the fixing section (110), the sewing process may be performed multiple times. Also, a three head-sewing machine may be used to sew the sewing portions.

An example of a sewing process for a three head-sewing machine may include sewing at a length of "X/2" for strands having a length of "X" with the first sewing head. Next, the strands are then folded in half and sewed by the second sewing head at the sewn line. The strands are then sewn by the third sewing head so that the strands are firmly fixed.

Additionally or alternatively, a fixing section (110) may be formed and/or reinforced by adhesives. For example, adhesives may be spread on portions of the sewn section. Also, the fixing section may contain an adhesion coating layer formed on or around the fixing section.

The hairpiece (100) may include a group of 700 or 800 fiber single-ply threads per a width of at least 1 cm. If the number of fiber single-ply threads (105) in the group is less than 700 threads per 1 cm, the continuity of the design formations (135) may be affected such that the designs may appear smudged, distorted, or incomplete. If the number of fiber single-ply threads in the group is greater than 800 threads per 1 cm width, the transcribed dispersion dyes that form the designs (135) on the fiber single-ply threads (105) may be insufficient to form a clean image. Accordingly, under these conditions substantially outside the specified range, the image may appear distorted.

In the non-limiting example illustrated in FIG. 1, the fixing section (110) includes stitches (112). Optionally, cross-stitches may also be added. Each stitch (112) contains between 80 and 100 fiber single-ply threads (105). However, any number of threads, which would be suitable for a stitch, could be used.

Figure 2:
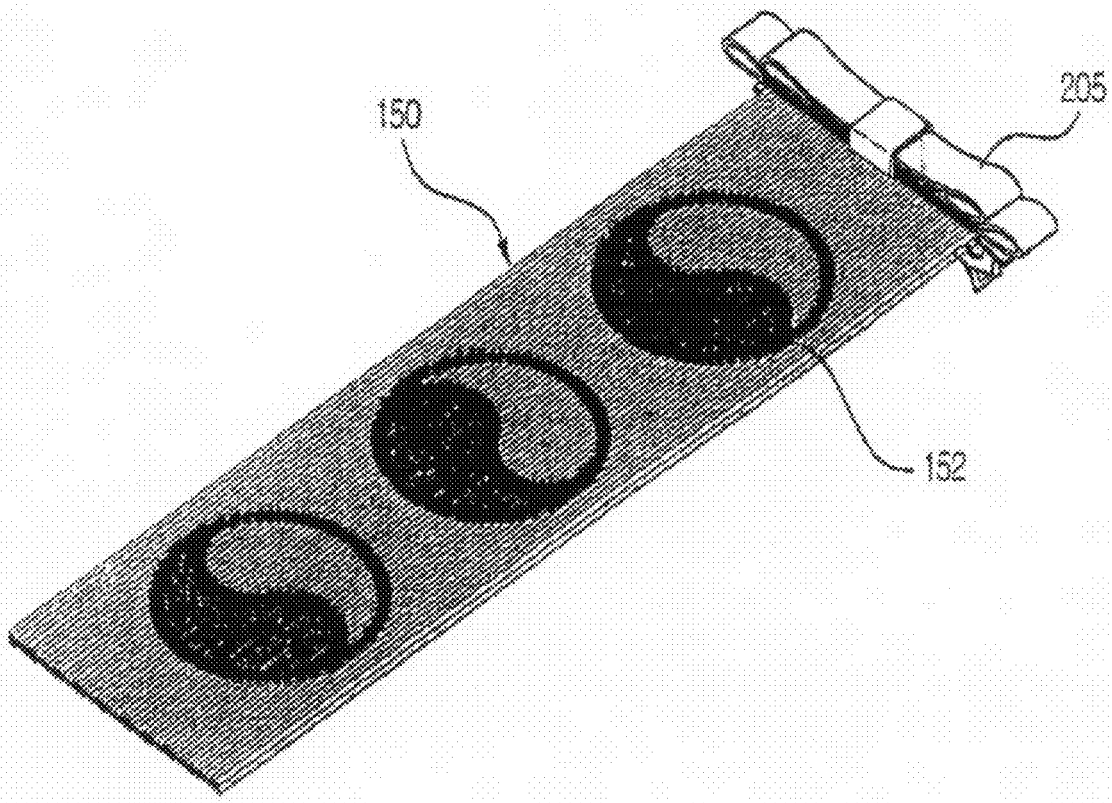
FIG. 2 is an exemplary and non-limiting illustration of a front perspective view of a hairpiece including an attaching member in accordance with another embodiment of the present invention.
Figure 3:
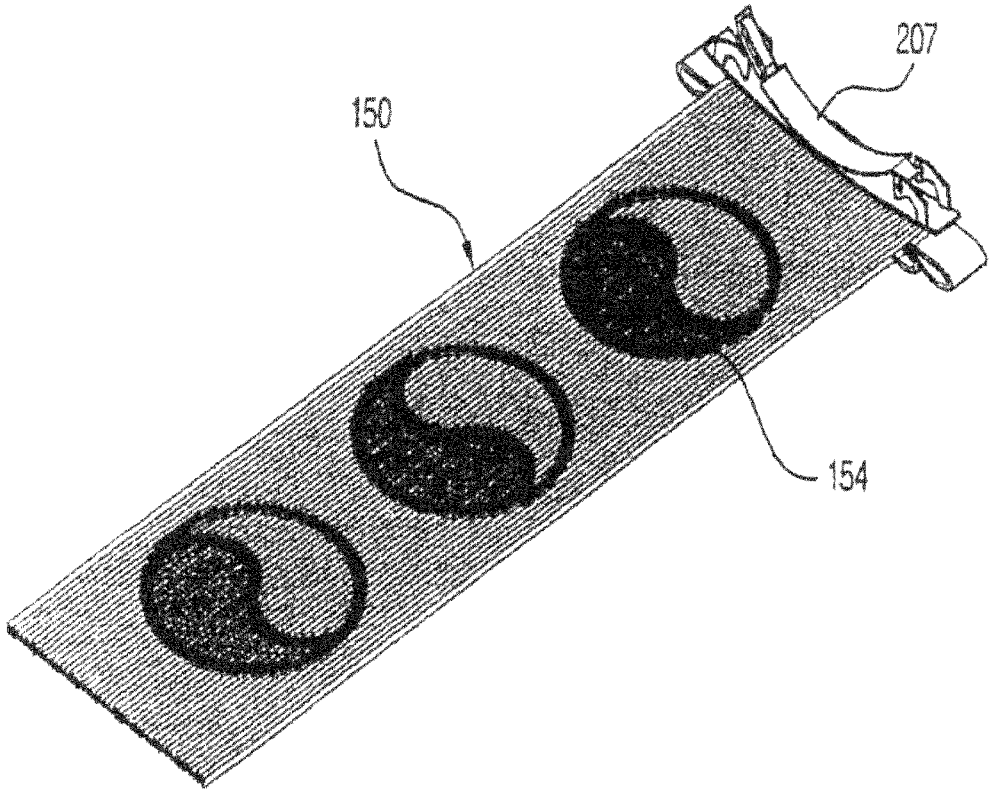
FIG. 3 is an exemplary and non-limiting illustration of a rear perspective view of the hairpiece illustrated in FIG. 2.

FIG. 2 and FIG. 3 illustrate non-limiting examples of a hairpiece that includes an accessory (205) and a connecting part (207) in accordance with one embodiment of the present invention.

In this non-limiting example, the connecting part (207) is configured to attach or connect the hairpiece, for example, to actual hair. However, the connecting part (207) may be configured to attach or connect to any desired element or material and at any desired location.

The accessory (205) is attached or connected to at least a portion of the fiber single-ply threads. For example, the accessory (205) may be connected to a fixing section.

Various methods and processes may be used to connect or attach the fiber single-ply threads to the accessory (205) and/or connecting part (207). For example, adhesives may be included and/or applied between the fixing section of the fiber single-ply thread group (150) and at least a portion of the accessory (205) and/or connecting part (207).

As illustrated in FIG. 2 and FIG. 3, the design patterns (152, 154) are mirror images of each other. A surface of the fiber single-ply thread group (150) is substantially discontinuous at least since the group includes a plurality of fiber single-ply threads. Regardless, the design patterns (152, 154) may be formed such that they appear to be substantially continuous. To achieve this continuous appearance, the designs may be formed on the surface of the fiber single-ply thread group (150) as described below.

More specifically, various designs and techniques may be used to decorate, supplement, and/or enhance the fiber single-ply thread group. For example, designs on the fiber single-ply thread group (150) may be created using transcription paper.

Figure 4:
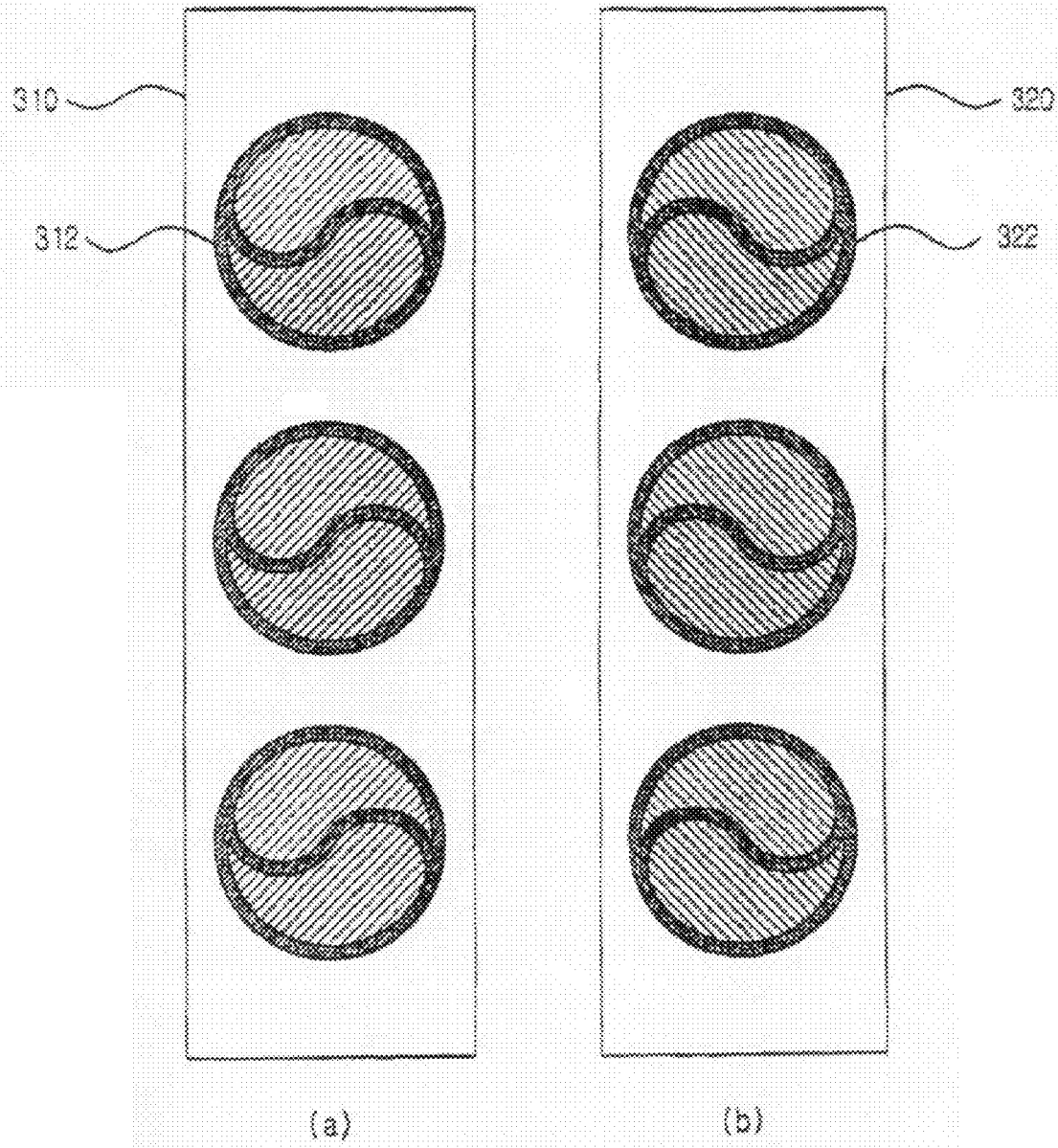
FIGS. 4*a* and 4*b* are exemplary and non-limiting illustrations of designs formed on a design producing medium such as transcription paper, which may be applied to a front side and a rear side of a fiber single-ply thread group in accordance with one embodiment of the present invention.

FIGS. 4*a* and 4*b* are non-limiting examples of designs or patterns (312, 322) provided on transcription paper (310, 320), which may be applied in accordance with one embodiment of the present invention. Referring to FIGS. 4*a* and 4*b*, the transcription paper (310, 320) includes designs and patterns that are applied to front and rear surfaces of the fiber single-ply thread group of the hairpiece.

The design patterns (312, 322) are mirror images of each other as shown in FIGS. 4*a* and 4*b*. However, these designs do not have to be mirror images or the same design if a different design pattern is desired for the front and rear surface of the fiber single-ply threads group.

The transcription paper (310, 320) may comprise separate and distinct pieces that are placed at front and rear surfaces of the fiber single-ply threads group, as shown in FIGS. 4*a* and 4*b*. Alternatively, the transcription paper may be folded and heat pressed with the hairpiece positioned between the two inner surfaces of the folded transcription paper.

The transcription paper (310, 320) contains dispersion dyes of a thin film on a surface of the transcription paper (310, 320). The dispersion dyes form designs and/or patterns of a single color or various colors. According to one embodiment, the dispersion dyes have properties such that dye dispersed on one side of the fiber single-ply threads group does not seep through towards the other side of the fiber single-ply threads group. The transcription paper (310, 320) may include and may be configured to include any type of dispersion dye or any type of coloring agent that would work effectively with the transcription paper.

For example, the transcription paper may include azo based dyes and/or anthraquinone based dyes. Azo based dyes and/or anthraquinone based dyes are typically incorporated in the transcription paper as the material, which is to be transcribed or copied during the printing process. As an example, azo based compounds may have a molecular formula of the form R—N=N—R', in which R and R' can be either aromatic or aliphatic. The N=N group is generally referred to as an azo or a diimide functional group. Aromatic azo compounds (R=R'=aromatic) are generally stable. Anthraquinone (9, 10-dioxoanthracene) is an aromatic organic compound and a derivative of anthracene. Typically, anthraquinone is used in production of dyes.

To print an image, the plurality of fiber single-ply threads are arranged in the manner that would produce the desired printing results, irrespective of the number of surfaces of the plurality of single-ply threads that are being printed. To print the front and rear surfaces of the fiber thread group, the plurality of fiber single-ply threads are positioned on or underneath at least one surface of transcription paper such that the design will transfer to the fiber single-ply threads at the desired locations. Also, to print on the front and rear surfaces, the printing may occur one surface at a time or simultaneously on multiple surfaces. Optionally, the plurality of single-ply threads may be arranged on or underneath a surface of transcription paper if printing is intended for a single surface of the plurality of single-ply threads group. Prior to printing, transcription paper may be positioned such that it is in contact with at least one surface of the plurality of fiber single-ply threads.

Additional temporary securing devices may be used to hold or ensure proper placement and alignment of each of the plurality of fiber single-ply threads. These optional temporary securing devices may be used to ensure that none of the plurality of fiber single-ply threads move out of position.

A heat pressing process allows design patterns (312, 322) to be transcribed on and/or transferred to at least one side of the fiber single-ply thread group. When sufficient heat is applied to the transcription paper, design patterns are transcribed from the transcription paper to a surface of the fiber single-ply threads group and dye is sublimated to the surface of the fiber single-ply threads group. Specifically, the dye is sublimated to the threads of the fiber single-ply threads group at portions that the dye contacts.

Selecting a sufficient temperature for the process of heat pressing may include considering the properties of the fiber single-ply threads and determining a particular temperature or range of temperatures that would allow the dispersion dye to be transferred from the transcription paper to the fiber single-ply threads without causing any damage or defects. For example, if the fiber single-ply threads include polyester, then a sufficient temperature for the heat pressing process may be within a range of approximately 220° C. to 240° C. However, in this case, if the temperature of the process is substantially less than 220° C. during heat press, the dispersion dyes may not sufficiently disperse onto the fiber single-ply threads group. Also, in this case, if the temperature of the process is substantially greater than 240° C., the fiber single-ply threads may warp and/or change shape and/or may be damaged by the relatively high temperature. Accordingly, for the heat pressing process, temperatures in a range of 225° C. to 230° C. may be preferred for fiber single-ply threads that include polyester.

The heat pressing process typically lasts between 3 and 4 minutes. After the heat pressing process, the plurality of fiber single-ply threads may undergo a conditioner treatment process that includes applying conditioner to the fiber single-ply threads. Also, if desired, the plurality of single-ply thread group may undergo an anti-static treatment process, which may include applying an antistatic coating to the fiber single-ply threads in order to prevent electric discharge or the accumulation of electric charge. In addition, the fiber single-ply threads may be styled (513).

FIGS. 1-3 illustrate hair pieces that have undergone a straightening process in which heat was applied to style the hairpiece. However, a number of different styles and styling techniques may be applied to the plurality of fiber single-ply threads. Examples of styles and styling techniques that may be applied to the plurality of fiber single-ply threads include at least curling, braiding, crimping, twisting, layering, and cutting, as well as other enhancing techniques. Further, the conditioning treatment process, the anti-static treatment process, and the styling can be performed in any order.

Figure 5:
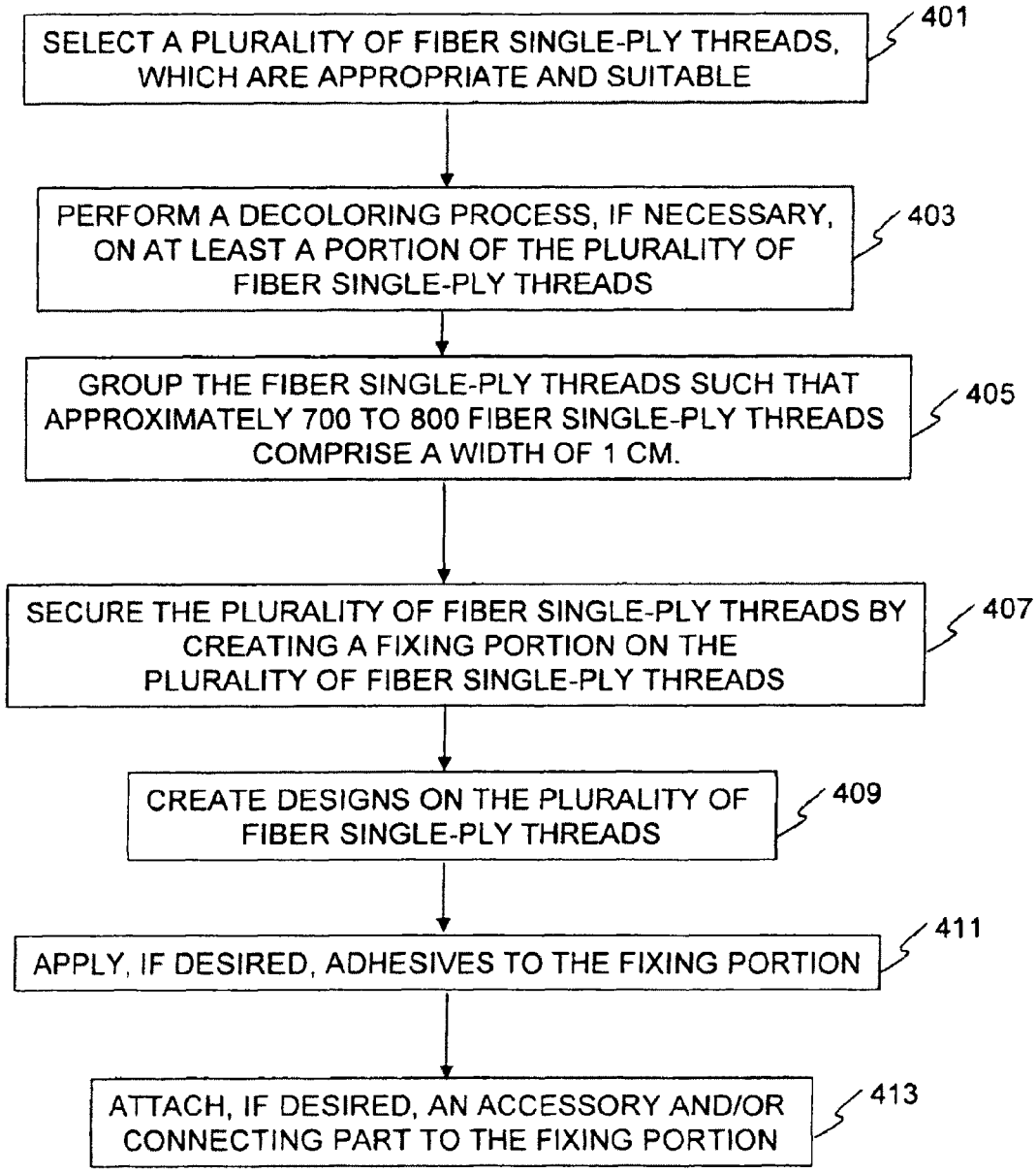
FIG. 5 is an exemplary and non-limiting illustration of a method of creating a decorated fiber single ply thread group in accordance with one embodiment of the present invention.

In addition, FIG. 5 is a flow chart illustrating one exemplary method of creating a hairpiece with designs formed on the plurality of single-ply threads. In step 401, the method includes selecting a plurality of fiber single-ply threads, which are appropriate and suitable. Step 401 proceeds to step 403, which includes optionally performing a decoloring process on at least a portion of the plurality of fiber single-ply threads. In step 405, the plurality of fiber single-ply threads are grouped such that approximately 700 to 800 fiber single-ply threads comprise a width of 1 cm. The method further includes securing the plurality of fiber single-ply threads by creating a fixing portion on the plurality of single-ply threads, as shown in step 407. In step 409, designs are created on the plurality of single-ply threads. If desired, the process may proceed to step 411, which includes applying adhesives to the fixing portion. The process may also proceed, if desired, to step 413, which includes attaching an accessory and/or connecting part to the fixing portion.

In the exemplary method illustrated in FIG. 5, the ordering of some of the steps may be modified. For example, the order of steps 509, 511, and 513 may be modified or rearranged in accordance with the desired hairpiece design.

Figure 6:
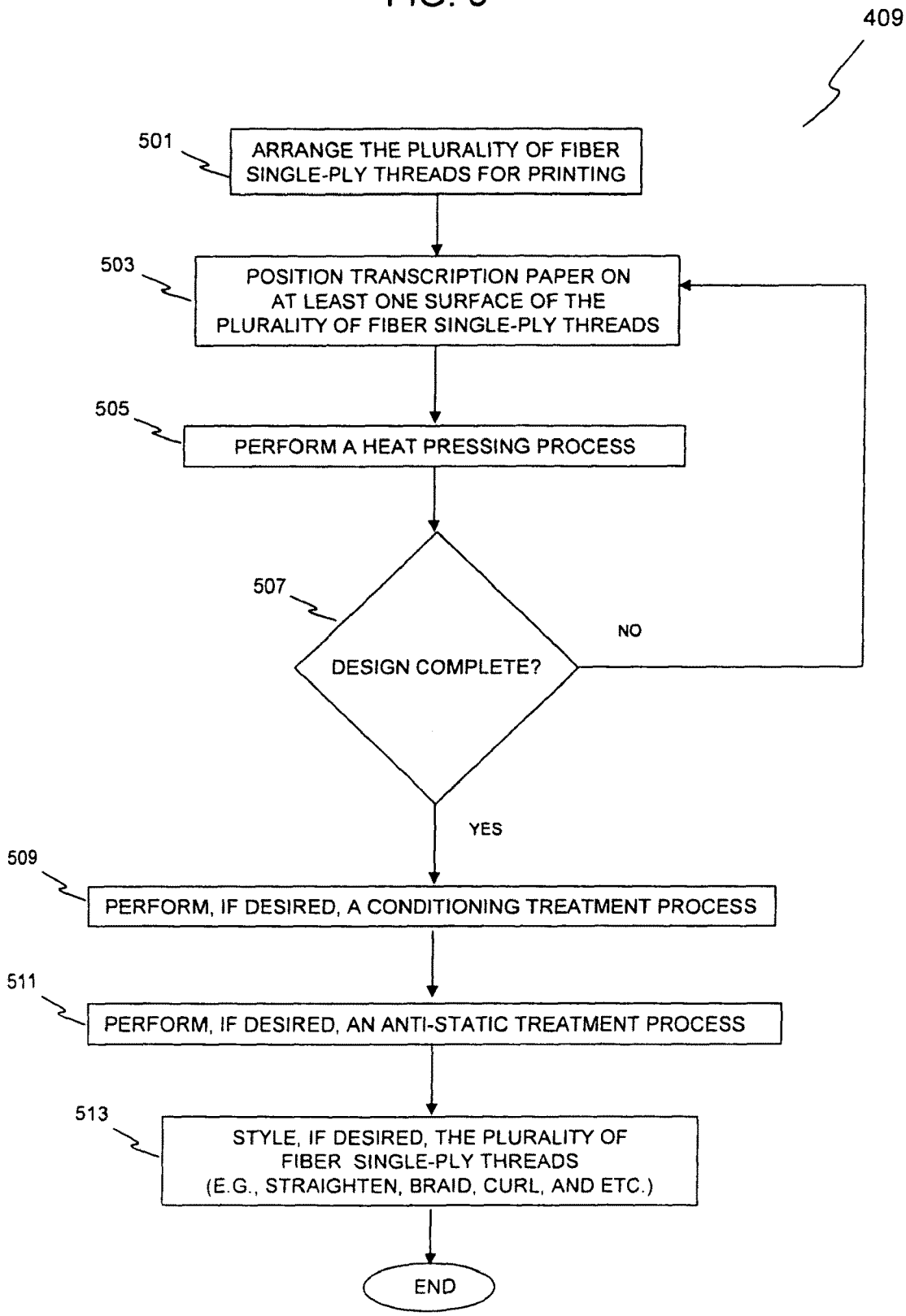
FIG. 6 is an exemplary and non-limiting illustration of a method of decorating a fiber single ply thread group in accordance with one embodiment of the present invention.

FIG. 6 further illustrates one exemplary method that could be implemented in step 409 during the process of creating designs on a plurality of fiber single-ply threads. For example, the design creation process may include arranging the plurality of fiber single-ply threads for printing, as shown in step 501. The method may also proceed to step 503, which includes positioning transcription paper on at least one surface of the plurality of fiber single-ply threads. In step 505, a heat pressing process is performed. Step 507 includes determining if the design is complete.

If it is determined that the design is not complete (NO), then the process may proceed back to at least step (503) to ensure that transcription paper is positioned on at least one surface of the plurality of fiber single-ply threads. Also, a heat pressing process (505) may be carried out again, if necessary.

If it is determined that the design is complete (Yes), then the method progresses to steps 509, 511, and 513 if the results obtained from these steps are desired. Step 509 includes performing a conditioning treatment process. Step 511 includes performing an anti-static treatment process. Step 513 includes styling the plurality of fiber single-ply threads. Styling may include straightening, braiding, curling, and any other technique or combination of techniques.

Although the hairpiece in this disclosure includes a heat pressing process and the transfer of design patterns on the fiber single-ply threads via dispersion dyes, the present invention is not limited to these materials or processes.

It should also be appreciated that any suitable materials or processes, such as stencils or printing plates, may be used to create a design on a surface of the plurality of fiber single-ply threads.

It will be appreciated that various unforeseen or unanticipated features, modifications, variations, improvements, alternatives or any combination thereof may be made by those skilled in the art, and are also intended to be encompassed by the following claims.

What is claimed is:

1. A method for creating designs on a plurality of fiber single-ply threads, said method comprising:

aligning a plurality of fiber single-ply threads having a decolorized portion;

grouping the plurality of fiber single-ply threads such that designs are captured on selected portions of the single ply-threads;

creating a fixing section to hold a portion of the plurality of fiber single-ply thread groups;

positioning transcription material on the plurality of fiber single-ply threads; and heat pressing the transcription material to the plurality of fiber single-ply threads to produce a design on the selected portions of the plurality of fiber single-ply threads.

2. The method according to claim 1, further comprising attaching a connecting part to the plurality of fiber single-ply threads, the connecting part being configured to attach and detach the plurality of fiber single-ply threads to an entity.

3. The method according to claim 2, further comprising coating the fixing section with adhesives.

4. The method according to claim 1, wherein the heat pressing occurs for approximately 1 to 4 minutes at a temperature approximately between 220° C. and 240° C.

5. The method according to claim 1, wherein the transcription material includes a first transcription portion having a first image and a second transcription portion having a second image.

6. The method according to claim 5, further comprising simultaneously heat pressing first and second transcription portions on front and rear sides of the plurality of fiber single-ply threads.

7. The method according to claim 1, wherein the grouping includes setting a 1 cm dimension of the hairpiece to include approximately 700 to 800 fiber single-ply threads.

* * * * *